US006883186B1

(12) United States Patent
Hernandez

(10) Patent No.: US 6,883,186 B1
(45) Date of Patent: Apr. 26, 2005

(54) IN-TANK LID POSITION CONTROL

(76) Inventor: Roland Hernandez, 1044 Balsa Cir., La Verne, CA (US) 91750

( * ) Notice: Subject to any disclaimer, the term of this patent is extended or adjusted under 35 U.S.C. 154(b) by 20 days.

(21) Appl. No.: 10/456,725

(22) Filed: Jun. 4, 2003

(51) Int. Cl.[7] ..... A47K 13/10
(52) U.S. Cl. ..... 4/246.1; 4/246.2
(58) Field of Search ..... 4/246.1–246.3, 4/246.5, 250, 253

(56) References Cited

U.S. PATENT DOCUMENTS

| | | | | |
|---|---|---|---|---|
| 1,907,826 | A | | 5/1933 | Kapp |
| 3,579,664 | A | | 5/1971 | Johnson |
| 5,058,216 | A | | 10/1991 | Trayer et al. |
| 5,177,818 | A | | 1/1993 | Tsai |
| 5,222,260 | A | | 6/1993 | Piper |
| 5,289,593 | A | | 3/1994 | Lawrence |
| 5,319,810 | A | * | 6/1994 | Metzger ..... 4/246.2 |
| 5,430,897 | A | | 7/1995 | Lavender |
| 5,592,700 | A | | 1/1997 | Genesse |
| 5,689,838 | A | | 11/1997 | MacKenzie |
| 5,754,985 | A | | 5/1998 | Dias |
| 5,774,904 | A | | 7/1998 | McWilliams |
| 5,781,938 | A | | 7/1998 | Anderson |
| 5,867,843 | A | | 2/1999 | Robello et al. |
| 6,240,574 | B1 | | 6/2001 | Mayyak |
| 6,438,764 | B1 | | 8/2002 | Andersen |
| 6,526,600 | B1 | | 3/2003 | Hernandez |

* cited by examiner

*Primary Examiner*—Khoa D. Huynh
(74) *Attorney, Agent, or Firm*—William W. Haefliger

(57) ABSTRACT

Apparatus to displace a raised toilet cover or seat member, comprising an actuator movable generally endwise toward a location defined by the raised toilet seat or cover, a mechanism within the toilet tank to urge the actuator endwise from a retracted position in response to lowering of the surface level of water in the tank, and toward that location to effect lowering of the seat or cover, the actuator thereafter being movable toward its retracted position.

11 Claims, 2 Drawing Sheets

IN-TANK LID POSITION CONTROL

BACKGROUND OF THE INVENTION

This invention relates generally to operation of flush toilets, and more particularly to a device to automatically manipulate a toilet lid or cover or seat.

There is long standing need to assure hat raised toilet lids or covers or seats are closed after a flush toilet use. There is also need for a very simple inexpensive and rugged device that will fulfill this need.

SUMMARY OF THE INVENTION

It is a major object of the invention to provide such a needed device or apparatus to manipulate and automatically close a toilet, in response to lowering of the water level in the toilet tank, as during toilet flushing after toilet use. Basically, the apparatus of the invention comprises:

a) an actuator movable generally endwise toward a location defined by the raised toilet seat or cover, b) mechanism within the toilet tank to urge the actuator endwise from a retracted position in response to lowering of the surface level of water in the tank, and toward said location to effect lowering of the seat or cover, c) the actuator thereafter being movable toward its retracted position.

Another object of the invention is to provide an opening in a toilet tank wall, so that the actuator, such as a rod, may project or move through that opening from the tank interior, and toward the location defined by the raised toilet seat or cover.

A further object is to provide a guide sleeve carried by the tank wall and in which the rod is endwise movable. As will be seen, the sleeve may have an entrance facing the tank interior, the rod loosely received in that entrance.

Yet another object is to provide the referenced mechanism to include a pusher receivable in the tank interior for pushing the rod endwise toward said location in response to lowering of water level in the tank. The mechanism may also include a weight suspended to float in the water in the tank, whereby force exerted by the weight as it descends with the tank water is transferred to the pusher, for effecting said pushing of the rod endwise. The pusher may advantageously include a flexible line operatively connected to the weight and to the rod to flex and push the rod endwise as the weight descends. Line displacement guides for the flexible line may also be provided.

A further object includes provision of a spring positioned in the tank to yieldably urge the rod toward said retracted position, as accommodated by water rising in the tank. A spring arm, and an optimal auxiliary spring may be located in the tank, as will be seen, whereby the pusher line may also be retracted.

These and other objects and advantages of the invention, as well as the details of an illustrative embodiment, will be more fully understood from the following specification and drawings, in which:

DRAWING DESCRIPTION

DETAILED DESCRIPTION

Figure 1:
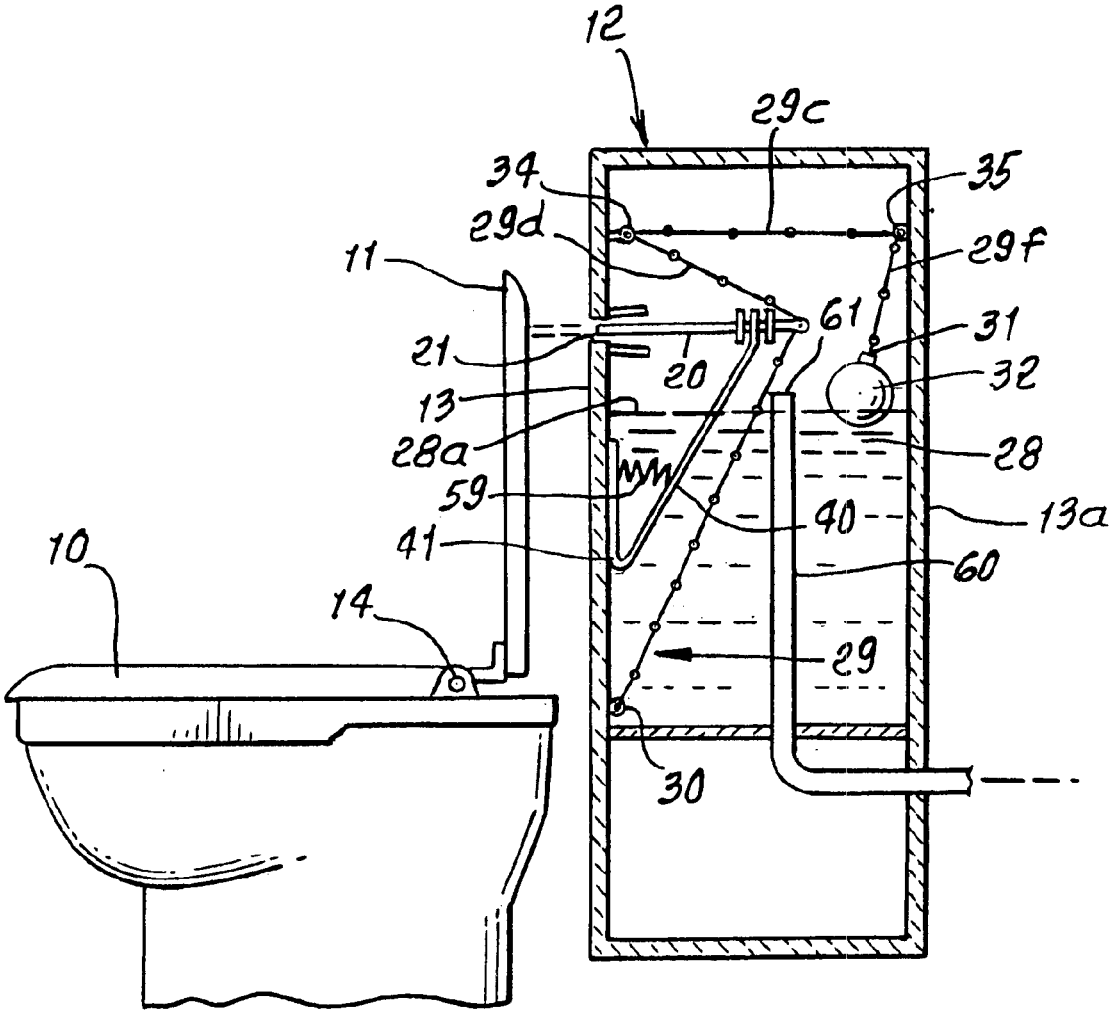
FIG. 1 is an elevation showing basic features of the invention.

In FIG. 1, a toilet seat and pivotable cover are shown at 10 and 11, and a flush water tank 12 has a front wall 13 facing the raised cover. A pivot for the cover is seen at 14, enabling pivoting between raised and lowered positions. Apparatus is provided to displace the cover 11, and/or to displace the seat itself if it is pivoted to swing between raised and lowered position.

The preferred mechanism includes:

a) an acuator movable generally endwise toward a location defined by the raised toilet seat or cover, b) mechanism within the toilet tank to urge the actuator endwise from a retracted position in response to lowering of the surface level of water in the tank, and toward said location to effect lowering of the seat or cover, c) the actuator thereafter being movable toward said retracted position.

Typically, the tank front wall 13 has an opening through which the actuator projects for movement toward said location defined by the raised toilet seat or cover.

Figure 2:
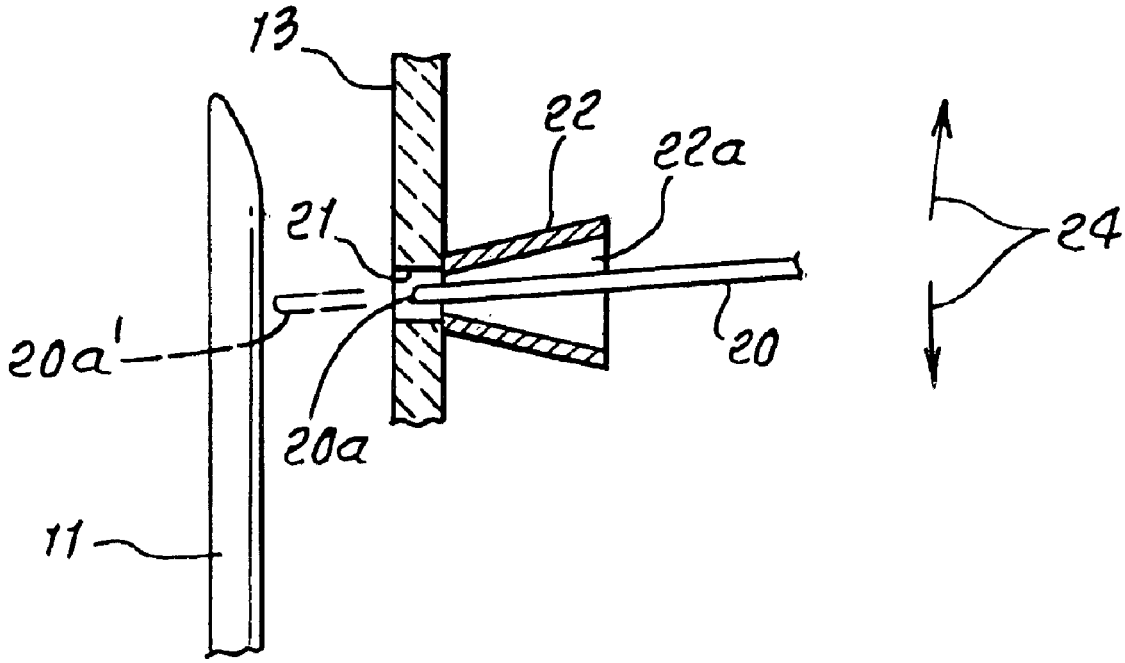
FIG. 2 is an enlarged section showing a guide sleeve at the tank wall.

In the example, the actuator includes a rod 20 in endwise alignment with the wall opening 21, whereby the rod may be displaced endwise so that the rod forward end 20*a* moves at the front side of wall 13 toward the cover and/or seat, to engage and displace the cover or seat upper portion leftwardly, whereby the cover or seat then swings downwardly to lowered position. The through opening 21 can be quite small (less than ¼ inch in diameter) so as not to be readily noticeable. Also, the forward end 20*a* of the rod can normally be concealed in wall 13, as for example in opening 21 or in an elongated guide sleeve carried by wall 13. See for example the sleeve 22 in FIG. 2 that receives the rod forward end, for endwise displacement to position 20*a*', engaging the toilet seat cover. The sleeve entrance end portion 22*a* can be somewhat divergent in a rearward direction, to accommodate to a degree of rod lateral movement (see arrows 24), as during rod guided endwise movement.

The mechanism to urge the actuator endwise, as described, may typically include a pusher receivable in the tank interior for pushing the rod endwise toward said location in response to said lowering of water level in the tank. Such mechanism typically includes a weight 32 suspended to float in the tank water 28, whereby force exerted by the weight as it descends in the tank water is transferred to the pusher for effecting such pushing of the rod endwise. In the preferred example, the pusher includes a flexible line 29 operatively connected to the weight and to the rod, to flex and push the rod endwise as the weight descends. As shown, the line has one end 30 anchored (as for example hooked) to wall 13 inner side at a lower location 13*a*, and an opposite end 31 anchored to weight 32, to travel downwardly as the weight descends upon lowering of the water surface 28*a*.

Figure 3:
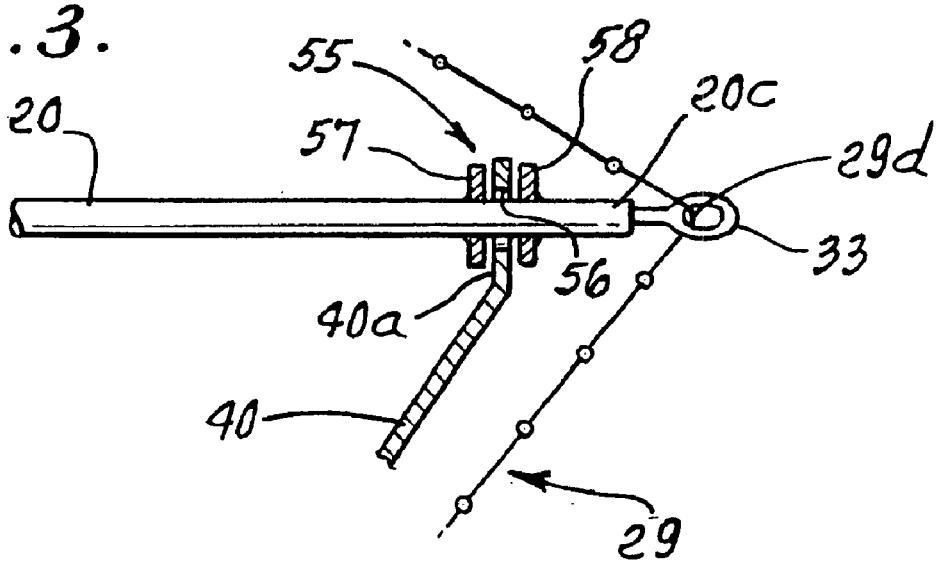
FIG. 3 is an enlarged section showing certain mechanism operable to control actuator movement.

The flexible line 29 (such as a chain) has an intermediate portion acting upon the end portion 20*c* of the rod to urge or push the rod leftwardly as the weight descends. See for example FIG. 3 showing the line intermediate portion 29*d* extending through a loop or ring 33 attached to the end portion 20*c*, to travel through the loop or ring as the line is tensioned, endwise.

The line also travels through a ring or loop 34 attached to the tank wall 13 at an upper level, the line portion 29*c* then extending rearwardly to pass through a ring or loop 35 attached to tank wall 13*a*. The line then extends downwardly at 29*f* to attach to the weight at 31.

Also provided is a spring positioned in the tank to yieldably urge the rod toward said retracted position, as accommodated by water rising in the tank. As shown, the spring includes a flat spring arm 40 anchored to the tank, as at 41, and extending toward the rod for operative connection to the rod. Such connection is preferably loose, i.e. a lost-motion type connection, to allow for rod limited lateral displacement due to drag of line 29. See one loose type connection at 55 in FIG. 3, for example. The flat spring arm 40 has an oversized opening 56 to pass the rod; and flanges 57 and 58 on the rod loosely captivate the arm portion 40*a*. Looseness of fits at 56 and at sleeve 22 and opening 21, prevents binding during rod movement. An auxiliary spring is provided at 59.

The lower end of the arm can be attached to the tank wall; or the flat spring arm may have an extension 40*a* bent upwardly from a location 41, to extend adjacent to wall 13 or be attached to that wall.

A water overflow drain 60 has an inlet 61 in the tank, below the level of opening 21 that passes the rod.

I claim:

1. An apparatus disposed within a toilet tank to displace a raised toilet cover or seat member, comprising, in combination:

a) an actuator movable generally endwise toward a location defined by the raised toilet seat or cover, b) mechanism within the toilet tank to urge the actuator endwise from a retracted position in response to lowering of the surface level of water in the tank, and toward said location to effect lowering of the seat or cover, c) the actuator thereafter being movable toward said retracted position, d) the toilet tank having a wall defining an opening through which the actuator projects for movement toward said location defined by the raised toilet seat or cover, e) the actuator including a rod in endwise alignment with said opening, f) said mechanism including a pusher receivable in the tank interior for pushing the rod endwise toward said location in response to said lowering of water level in the tank, g) and including a spring positioned in the tank to yieldably urge the rod toward said retracted position, as accommodated by water rising in the tank.

2. The combination of claim 1 including a guide sleeve carried by said wall and in which the rod is endwise movable proximate said wall.

3. The combination of claim 2 wherein the sleeve has an entrance facing the tank interior, the rod loosely received in said entrance.

4. The combination of claim 1 wherein said mechanism includes a weight suspended to float in the water in the tank, whereby force exerted by the weight as it descends in the tank water is transferred to the pusher for effecting said pushing of the rod endwise.

5. The combination of claim 4 wherein said pusher includes a flexible line operatively connected to the weight and to the rod to flex and push the rod endwise as the weight descends.

6. The combination of claim 5 including a first guide carried by the rod to pass said line.

7. The combination of claim 1 wherein said spring includes a spring arm anchored to the tank and extending toward the rod for operative connection to the rod.

8. The combination of claim 7, wherein said operative connection is a lost motion connection.

9. The combination of claim 1 including an overflow drain in the tank, having an inlet below the level of said opening.

10. An apparatus disposed within a toilet tank to displace a raised toilet cover or seat member, comprising, in combination:

a) an actuator movable generally endwise toward a location defined by the raised toilet seat or cover, b) mechanism within the toilet tank to urge the actuator endwise from a retracted position in response to lowering of the surface level of water in the tank, and toward said location to effect lowering of the seat or cover, c) the actuator thereafter being movable toward said retracted position, d) the toilet tank having a wall defining an opening through which the actuator projects for movement toward said location defined by the raised toilet seat or cover, e) the actuator including a rod in endwise alignment with said opening, f) said mechanism including a pusher receivable in the tank interior for pushing the rod endwise toward said location in response to said lowering of water level in the tank, g) said mechanism includes a weight suspended to float in the water in the tank, whereby force exerted by the weight as it descends in the tank water is transferred to the pusher for effecting said pushing of the rod endwise, h) said pusher including a flexible line operatively connected to the weight and to the rod to flex and push the rod endwise as the weight descends, i) and including a first guide carried by the rod to pass said line, j) and including at least one second guide carried by the tank to pass said line.

11. The combination of claim 10 including a spring positioned in the tank to yieldably urge the rod toward said retracted position, as accommodated by water rising in the tank.

* * * * *